US006500491B2

(12) United States Patent
Tomaru et al.

(10) Patent No.: US 6,500,491 B2
(45) **Date of Patent: *Dec. 31, 2002**

(54) COATING METHOD

(75) Inventors: Mikio Tomaru, Kanagawa (JP); Shinsuke Takahashi, Kanagawa (JP); Norio Shibata, Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/456,947

(22) Filed: Dec. 7, 1999

(65) Prior Publication Data

US 2002/0009548 A1 Jan. 24, 2002

(30) Foreign Application Priority Data

Dec. 8, 1998 (JP) ..... 10-348680

(51) Int. Cl.[7] ..... B05D 1/36; B05D 3/12

(52) U.S. Cl. ..... 427/402; 427/356; 427/358; 427/407.1

(58) Field of Search ..... 427/356, 358, 427/402, 407.1, 131; 118/410, 411

(56) References Cited

U.S. PATENT DOCUMENTS

| | | | | | |
|---|---|---|---|---|---|
| 4,525,392 | A | * | 6/1985 | Ishizaki et al. | 427/420 |
| 4,746,542 | A | * | 5/1988 | Chino et al. | 427/131 |
| 5,397,600 | A | * | 3/1995 | Shibata et al. | 427/358 |
| 5,425,967 | A | * | 6/1995 | Tomaru | 427/356 |
| 5,728,430 | A | * | 3/1998 | Sartor et al. | 427/356 |
| 5,728,454 | A | * | 3/1998 | Inaba et al. | 428/212 |

* cited by examiner

*Primary Examiner*—Michael Barr
(74) *Attorney, Agent, or Firm*—Sughrue Mion, PLLC

(57) ABSTRACT

There is provided a coating method in which an extrusion-type coating head having a plurality of doctor edge surfaces is pressed onto a flexible support laid and running between pass rollers so as to coat the flexible support with a coating composition ejected from a slit, the method comprising the steps of: preparing a lower-layer coating composition so as to have a viscosity of not less than 1 P at rest and a viscosity of not more than 50 cP at a shear rate of 10,000 $sec^{-1}$; excessively applying the lower-layer coating composition to a surface of the support; scraping a surplus of the lower-layer coating composition by the coating head so that a lower layer is formed; and applying an upper-layer coating composition, which is ejected from the slit, onto the lower layer.

9 Claims, 4 Drawing Sheets

COATING METHOD

BACKGROUND OF THE INVENTION

1. Field of the Invention

The present invention relates to a coating method suitable for forming a plurality of layers of coating on a flexible support running at a high speed in order to manufacture a magnetic recording medium, a photographic sensitive material, an electronic material, a coating-type battery, an optical film for anti-reflection or the like, abrasive tape, information recording paper, etc.

2. Description of the Prior Art

A technique for simultaneously forming a plurality of layers of thin coating films on a flexible support consisting of a plastic material or the like at a high speed by use of an extrusion-type coating apparatus is disclosed in Japanese Patent No. 2,581,975, JP-A-5-212337 and so on.

However, when the thickness of a coating film which was an undermost layer was made 10 $\mu$m or less in a wet state by the technique disclosed in these publications, the air (entrained air) moving with the running support might invade the coating film so as to cause coating unevenness. In addition, when an edge surface of a coating head and the flexible support were brought into a closer relationship to each other in order to form a thin coating film by the technique disclosed in the above-mentioned publications, foreign matters or the like adhering to the surface of the support might be mixed into a coating composition, or the support might be shaved by the edge surface of the coating head so that shavings produced thus were mixed into the coating composition. As a result, there might arise coating failure such as coating streaks or the like.

On the other hand, a technique in which an undercoating composition having low viscosity mainly composed of a solvent is applied onto a support in the upstream of a coating head, and the support is coated with a coating composition while a surplus of the undercoating composition is scraped by an end portion of an edge surface of the coating head is disclosed in Japanese Patent No. 2,601,367 or JP-A-6-134380. Here, a coating composition is applied onto the flexible support in which a gap between the support and the edge surface is sealed with the undercoating composition, so that the entrained air is prevented from invading the coating film. It is therefore possible to form a thin coating film on a support at a high speed.

However, when a coating film was to be formed on a support by the technique disclosed in Japanese Patent No. 2,601,367 or JP-A-6-134380, a solvent of an undercoating composition might pass through an adjacent coating film and make the surface of the coating film rough when the coating film was dried. When a solvent superior in compatibility with a coating composition for adjacent coating films was selected for an undercoating composition, the undercoating composition and the coating composition were dried simultanuously. As a result, such a disadvantage was improved. However, such an advantage might cause a problem in material requiring high degree of surface smoothness, such as a high-density magnetic recording medium or the like.

SUMMARY OF THE INVENTION

It is therefore an object of the present invention to solve the foregoing problems to thereby provide a coating method in which two or more layers of thin coating films can be formed on a flexible support at a high speed without making the surfaces of the coating films rough when the coating films are dried.

In order to achieve the foregoing object, according to a first aspect of the present invention, there is provided a coating method in which an extrusion-type coating head having a plurality of doctor edge surfaces is pressed onto a flexible support laid and running between pass rollers so as to coat the flexible support with a coating composition ejected from a slit, the method comprising the steps of: preparing a lower-layer coating composition so as to have a static viscosity of not less than 1 P and a viscosity of not more than 50 cP at a shear rate of 10,000 $sec^{-1}$; excessively applying the lower-layer coating composition to a surface of the support; scraping a surplus of the lower-layer coating composition by the coating head so that a lower layer is formed; and applying an upper-layer coating composition, which is ejected from the slit, onto the lower layer.

Preferably, according to a second aspect of the present invention, in the above coating method, respective coating compositions are prepared so that a difference in viscosity at a shear rate of 10,000 $sec^{-1}$ between coating compositions for layers adjacent to each other does not exceed 10 cP.

Preferably, according to a third aspect of the present invention, in the above coating method, at least a part of a downstream one of the doctor edge surfaces of the coating head projects over a tangent drawn from a downstream end of a most upstream one of the doctor edge surfaces toward a circumferential surface of a pass roller located just downstream from the coating head, the circumferential surface being in contact with the support.

Preferably, according to a fourth aspect of the present invention, in the above coating method, each of the doctor edge surfaces in the coating head has a curved surface which is convex toward the support, and a minimum value of a curvature radius of the curved surface in any doctor edge surface is smaller than that in any other doctor edge surface located in more downstream side.

The term "static viscosity" herein means viscosity measured by a Brookfield viscometer. The term "shear rate" means a ratio of change of speed of fluid in a direction perpendicular to the flow direction of the fluid flowing with shearing force applied thereto. The shear rate is also referred to as "rate of flow".

In the configuration of the coating method according to the first aspect of the present invention, not a background-art undercoating composition but a lower-layer coating composition adjusted in viscosity is excessively applied onto a support at the upstream of a coating head, and a surplus of the lower-layer coating composition is scraped by the coating head so that a lower layer is formed while an upper-layer coating composition is applied onto the lower layer. As a result, it is possible to reduce the interaction of particles in the coating compositions or the flow generated by the distribution of surface tension when a coating film is dried. It is therefore possible to conspicuously restrain the coating film surface from being coarse. The disorder of the interface between the upper and lower layers is also restrained.

Then, if the static viscosity is smaller than 1 P, the coating composition becomes easy to flow in the coating film surface when the coating composition is dried, so that it is impossible to restrain the coating film surface and interface from being coarse. On the other hand, if the viscosity of the lower-layer coating composition at a share rate of 10,000 $sec^{-1}$ exceeds 50 cP, the lower-layer coating composition cannot be scraped uniformly by a doctor edge, so that superior coating cannot be attained.

In the configuration of the above-mentioned method according to the first aspect of the invention, a plurality of upper layers may be formed on the lower layer. In this case, any interface between the upper layers adjacent to each other can be also restrained from being disordered.

In addition, with the configurations according to the above-mentioned second to fourth aspects of the invention, it is possible to further conspicuously restrain the coarsening of the coating film surface and the disorder of the interface. The most upstream-side doctor edge surface of the coating head stated in the above-mentioned configuration according to the third aspect of the invention is also referred to as a front edge surface.

DETAILED DESCRIPTION OF THE PREFERRED EMBODIMENT

Figure 1:
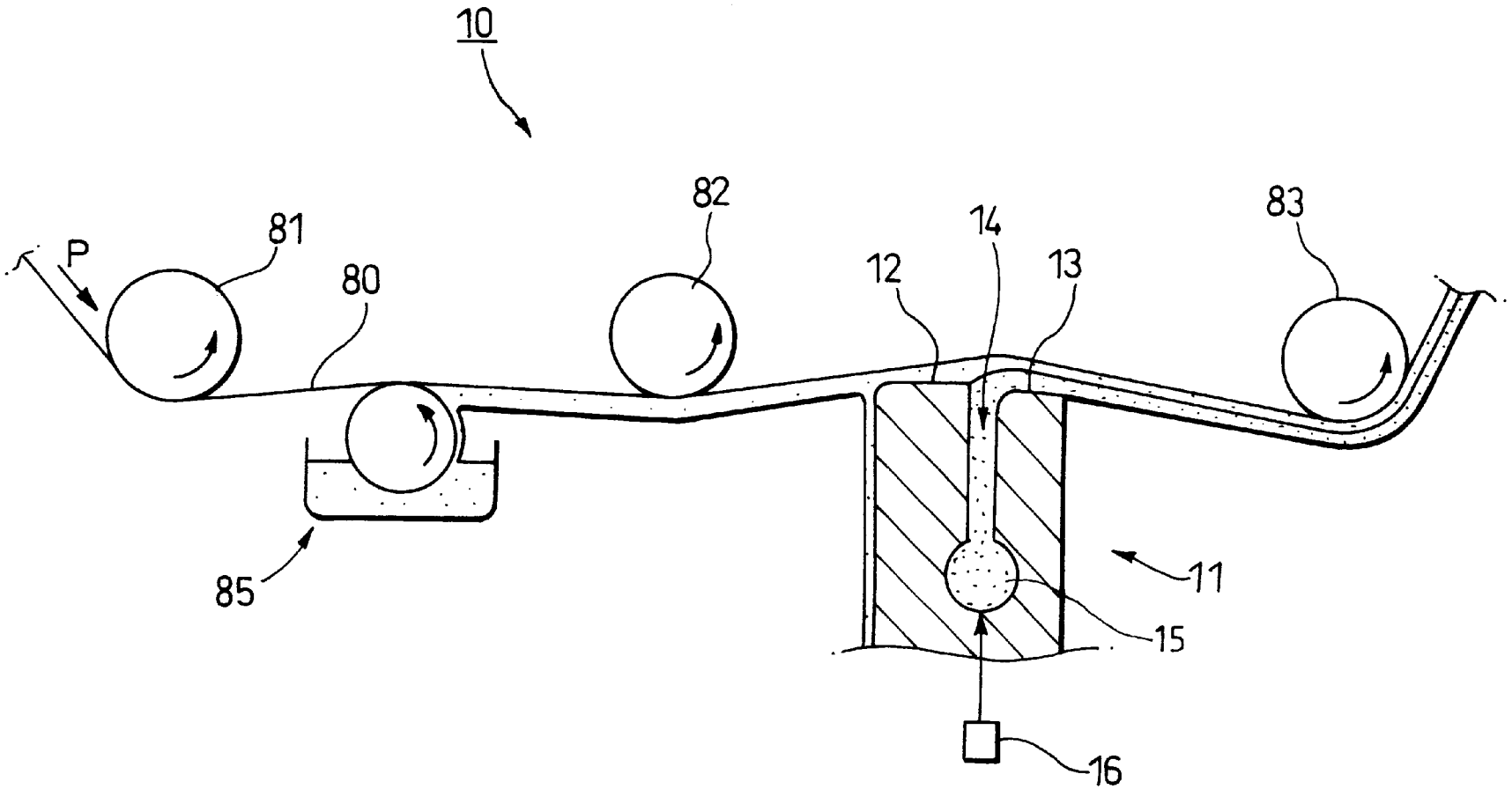
FIG. 1 is a view showing a coating equipment for carrying out the present invention.

An equipment for carrying out the present invention will be described below in detail with reference to FIG. 1. FIG. 1 shows a coating equipment 10 for coating two layers. The coating equipment 10 has first to third pass rollers 81 to 83 forming a carriage path for a support 80, a lower-layer coating apparatus 85 for applying a lower-layer coating composition (hereinafter referred to as "a lower-layer composition") onto the surface of the support 80, and an upper-layer coating apparatus 11 for applying an upper-layer coating composition (hereinafter referred to as "an upper-layer composition") onto the lower-layer composition.

As the support 80, preferably, there is used a material having a flexural rigidity in a range of from about $10^{-7}$ to about 1 kgf mm per width of 1 m in the thickness direction of the support. The support 80 may be a material in which a functional layer such as an adhesive layer or the like is formed in advance on the surface of the support 80 and dried or solidified. This support 80 is made to run on the pass rollers 81 to 83 under the condition that a tension in the carriage direction P thereof is in a range of from 5 to 50 kgf/m and a carriage speed is in a range of from 100 to 1,500 m/min.

The lower-layer coating apparatus 85 is disposed between the first and second pass rollers 81 and 82 on the upstream side of the upper-layer coating apparatus 11 which will be described below. A gravure coater, a slot coater, an extrusion coater, etc., other than a roll coater shown in FIG. 1, may be adopted as the lower-layer coating apparatus 85. A lower-layer composition is applied onto the support 80 by this coating apparatus 85 to a thickness in a range of from 5 to 20 $\mu$m in a wet state.

The composition or the like of the lower-layer composition is not limited specifically so long as it satisfies the following conditions.

First, the lower-layer composition must have a sufficiently low viscosity in the state where shear force is given thereto in order to attain superior coating. To this end, the lower-layer composition is adjusted so that the viscosity at a shear rate of 10,000 $sec^{-1}$ measured by a Rotovisko viscometer or the like is 50 cP or less, preferably 30 cP or less.

Secondly, the lower-layer composition must have a high viscosity in a static state. To this end, the lower-layer composition is adjusted so that the static viscosity measured by a Brookfield viscometer or the like is 1 P or more, preferably 10 P or more.

Such adjustment of the viscosity can be performed by adjusting the amount of solids in the composition, the molecular weight of binder, and so on. The lower-layer composition the viscosity of which is adjusted is applied onto the support 80 by the lower-layer coating apparatus 85 excessively so that the thickness exceeds the final thickness of the lower layer. Preferably, the lower-layer composition is applied excessively to a thickness of 120% or more of the final thickness of the lower layer.

The support 80 excessively coated with the lower-layer composition is carried by the pass rollers 81 to 83, and arrives at the upper-layer coating apparatus 11. A coating head of the upper-layer coating apparatus 11 having a plurality of doctor edge surfaces is pressed onto the support 80 laid between the second and third pass rollers 82 and 83 located in the upstream just before and in the downstream just after the coating apparatus 11 respectively. The coating head shown in FIG. 1 has a most upstream doctor edge surface (hereinafter referred to as "front edge surface") 12 and a downstream doctor edge surface 13. A slit 14 is formed between the front edge surface 12 and the doctor edge surface 13. In addition, the coating apparatus 11 includes a reservoir 15 communicating with the slit 14. The upper-layer composition is supplied from a coating composition supply source 16 to the reservoir 15 through a gear pump (not shown) or the like.

When the support 80 arrives at the upper-layer coating apparatus 11 through the lower-layer coating apparatus 85, the lower-layer composition successively applied onto the support 80 is in a wet state.

First, the upper-layer coating apparatus 11 makes the front edge surface 12 scrape a surplus of the lower-layer composition applied onto the support 80 so as to form a lower layer. The thickness of the lower layer formed at this time can be set by suitably adjusting the shape of the front edge surface 12, the angle of approach of the support 80 to the front edge surface 12, the tension in the carriage direction P of the support 80, the coating speed, and so on. Although the front edge surface 12 is constituted by a plane and a slope here, the shape is not limited specifically. For example, the front edge surface 12 may have a curved surface which is convex toward the support 80. In that case, foreign matters or the like adhering to the support 80 become difficult to be mixed into a coating composition, so that it is possible to restrain a coating failure from occurring.

Next, the upper-layer coating apparatus 11 applies an upper-layer composition discharged from the slit 14 onto the lower layer formed by scraping a surplus of the lower-layer composition. At this time, the gap between the support 80 and the front edge surface 12 is sealed with the lower-layer composition. The viscosity of the lower-layer composition is low under the condition that shear force is given thereto, so that there is no fear that the entrained air invades the upper-layer composition.

The coating film of the support 80 which has passed through the upper-layer coating apparatus 11 is dried or solidified. At this time, the static viscosity of the lower-layer composition is high so that the surface is restrained from being remarkably roughened.

In the coating equipment 10 and the coating method which have been described above, a lower-layer composition having an adequately higher viscosity than that of a background-art undercoating composition is excessively applied to a support, and a surplus of the lower-layer composition is scraped by a coating head so that a lower layer is formed before application of an upper-layer composition onto the lower-layer composition. Accordingly, the amount of a solvent or the like passing through the coating film is small when the coating film is dried. Therefore, the coarsening on the surface of the coating film and the disorder of the interface between the upper and lower layers are restrained conspicuously.

As shown in FIG. 1, the doctor edge surface 13 of the upper-layer coating apparatus 11 is located in the direction apart from the support 80 with respect to a tangent drawn from the downstream end of the front edge surface 12 to the circumferential surface of the pass roller 83 located just in the downstream rear side of the coating head which circumferential surface is in contact with the support 80. There is no fear that such a coating head scrapes foreign matters on the support by the doctor edge surface 13. Accordingly, superior coating can be attained when the upper-layer coating film is comparatively thick.

Figure 2:
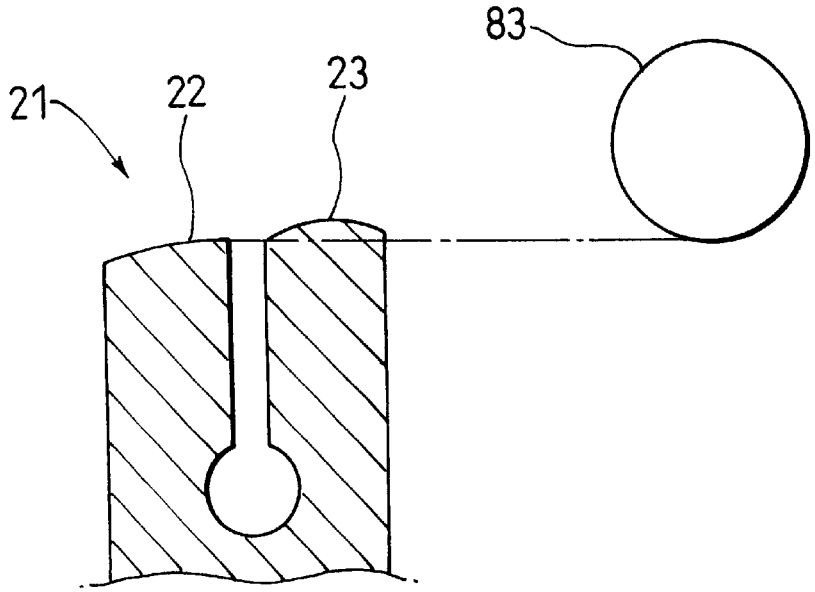
FIG. 2 is a view showing an upper-layer coating apparatus which can be used instead of an upper-layer coating apparatus of FIG. 1.

FIG. 2 shows another upper-layer coating apparatus 21 which can be used instead of the upper-layer coating apparatus 11 in the coating equipment 10 shown in FIG. 1. A coating head of the upper-layer coating apparatus 21 shown in FIG. 2 has a front edge surface 22 and a doctor edge surface 23 in the same manner as the coating head shown in FIG. 1. However, in this case, the doctor edge surface 23 projects over a tangent drawn from the downstream end of the front edge surface 22 to the circumferential surface of the pass roller 83 located just in the downstream rear side of the coating head.

In the upper-layer coating apparatus 21 configured thus, the distance between the support (not shown) and the doctor edge surface 23 is reduced by making the doctor edge surface 23 project toward the support, so that it is possible to make the upper-layer coating film thin. For example, when it is intended to form an upper layer to be 3 $\mu$m or less at a wet state, superior coating can be attained by this upper-layer coating apparatus 21. Then, the doctor edge surface 23 is preferably constituted by a continuous curved surface.

Figure 3:
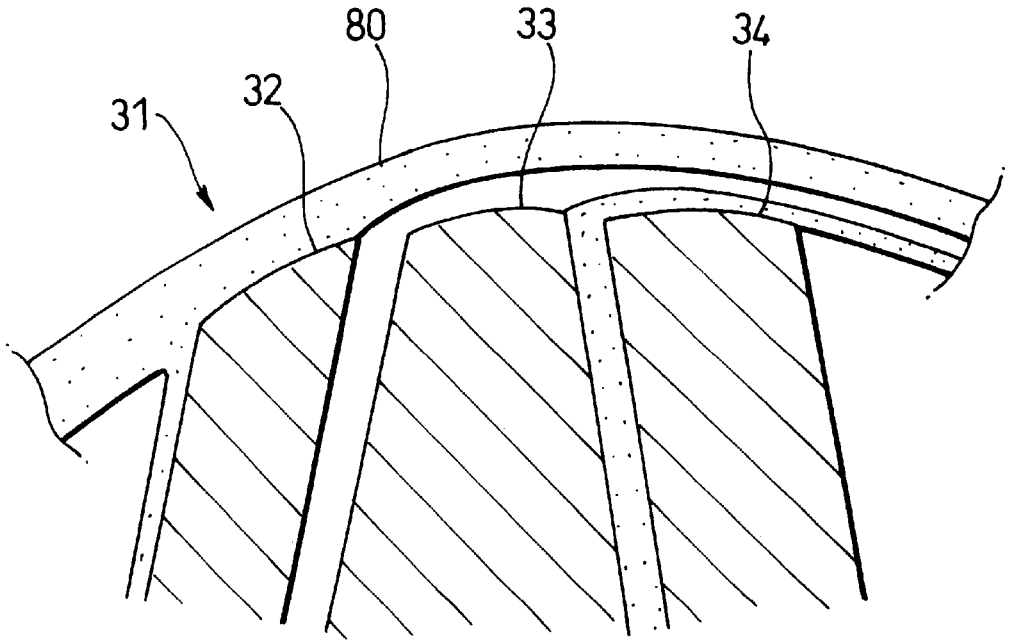
FIG. 3 is a view showing an upper-layer coating apparatus which can be used instead of the upper-layer coating apparatus of FIG. 1.

FIG. 3 shows a further upper-layer coating apparatus 31 which can be used instead of the upper-layer coating apparatus 11 in the coating equipment 10 shown in FIG. 1. The upper-layer coating apparatus 31 has a front edge surface 32, an intermediate doctor edge surface 33 and a downstream-side doctor edge surface 34 in order to form two layers of upper-layer coating films on a lower layer. It is preferable in this case that the front edge surface 32, the intermediate doctor edge surface 33 and the downstream-side doctor edge surface 34 are constituted by curved surfaces respectively.

It is further preferable that the minimum value of the curvature radius of the curved surface constituting each of the edge surfaces 32 to 34 becomes larger as the edge surface goes to the downstream side. In such a manner, the pressure of a coating composition is reduced as it goes to the downstream side, so that the coating composition can be accelerated. As a result, the coating composition can be applied thinly easily, and the disorder of the interface is also restrained conspicuously.

When two kinds of coating compositions are applied in order to form two layers of upper-layer coating films on a lower layer such that the thickness of each of the upper-layer coating films is 2 $\mu$m or less in a wet state, it is preferable that the values of the viscosity of the respective coating compositions are made close to each other. It is further preferable to adjust the respective coating compositions so that the difference of viscosity between the respective coating compositions does not exceed 10 cP at a shear rate of $10{,}000^{-1}$. In such a manner, the disorder of the interface between the upper-layer coating films adjacent to each other can be restrained more conspicuously.

EXAMPLES

The effects of the present invention will be made clear on the basis of examples.

Examples 1 to 8 and Comparative Examples 1 to 3

First, any one of 5 kinds of lower-layer compositions shown in Table 1 was applied onto a 10 $\mu$m polyethylene terephthalate support, which was running at a speed of 800 m/min by an extrusion coater so that the thickness was 30 $\mu$m in a wet state. Next, a surplus of the lower-layer composition was scraped by a coating head 1 shown in FIG. 4 or a coating head 2 shown in FIG. 5, so that a lower layer is formed. Any one of four kinds of coating compositions shown in Table 2 was applied onto the lower layer. Tables 1 and 2 show also the viscosity of the lower-layer compositions and the coating compositions.

TABLE 1

| | lower-layer composition recipe | | | | | |
|---|---|---|---|---|---|---|
| | $TiO_2$ (average particle size 0.035 $\mu$m) (parts by weight) | Polyvinyl chloride-acetate copolymer (D.P.400) (parts by weight) | Cyclo-hexanone (parts by weight) | Methyl ethyl ketone (parts by weight) | Viscosity at a shear rate of 10,000 $sec^{-1}$ (cP) | Static viscosity (cP) |
| lower-layer composition 1 | 100 | 12 | 110 | 110 | 61 | 2000 |
| lower-layer composition 2 | 100 | 25 | 110 | 110 | 49 | 81 |

TABLE 1-continued

| | lower-layer composition recipe | | | | | |
|---|---|---|---|---|---|---|
| | $TiO_2$ (average particle size 0.035 μm) (parts by weight) | Polyvinyl chloride-acetate copolymer (D.P.400) (parts by weight) | Cyclo-hexanone (parts by weight) | Methyl ethyl ketone (parts by weight) | Viscosity at a shear rate of 10,000 $sec^{-1}$ (cP) | Static viscosity (cP) |
| lower-layer composition 3 | 100 | 20 | 100 | 100 | 50 | 106 |
| lower-layer composition 4 | 100 | 16 | 100 | 100 | 46 | 1100 |
| lower-layer composition 5 | 100 | 15 | 120 | 130 | 31 | 1020 |

TABLE 2

| | coating composition recipe | | | | | |
|---|---|---|---|---|---|---|
| | Fe alloy (average major axis diameter 0.2 μm) (parts by weight) | Polyvinyl chloride-acetate copolymer (D.P.400) (parts by weight) | Cyclo-hexanone (parts by weight) | Methyl ethyl ketone (parts by weight) | Viscosity at a shear rate of 10,000 $sec^{-1}$ (cP) | Static viscosity (cP) |
| coating composition a | 100 | 12 | 100 | 100 | 51 | 2400 |
| coating composition b | 100 | 14 | 110 | 110 | 9 | 1400 |
| coating composition c | 100 | 12 | 90 | 90 | 65 | 3300 |
| coating composition d | 100 | 12 | 90 | 100 | 55 | 2500 |

Table 3 shows the conditions of application and the states of interfaces between respective layers obtained from the observation on the coating film sections.

Figure 4:
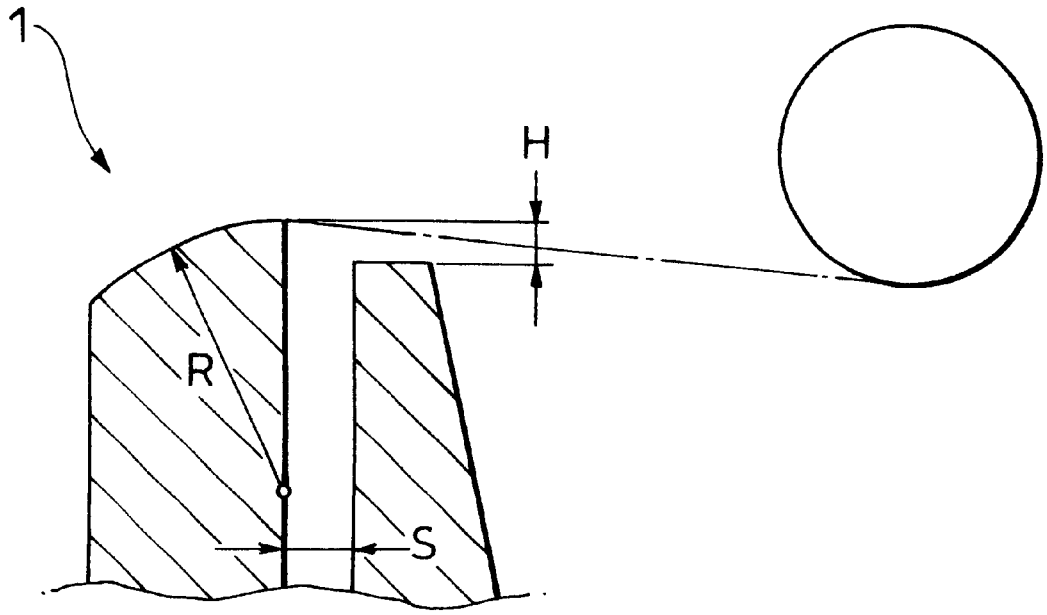
FIG. 4 is a view for explaining examples.

The designed dimensions of the coating head 1 shown in FIG. 4 were as follows. The front edge surface curvature radius R was 4 mm, the slit width S was 200 μm, and the difference of height between edge surfaces H was 30 μm.

Figure 5:
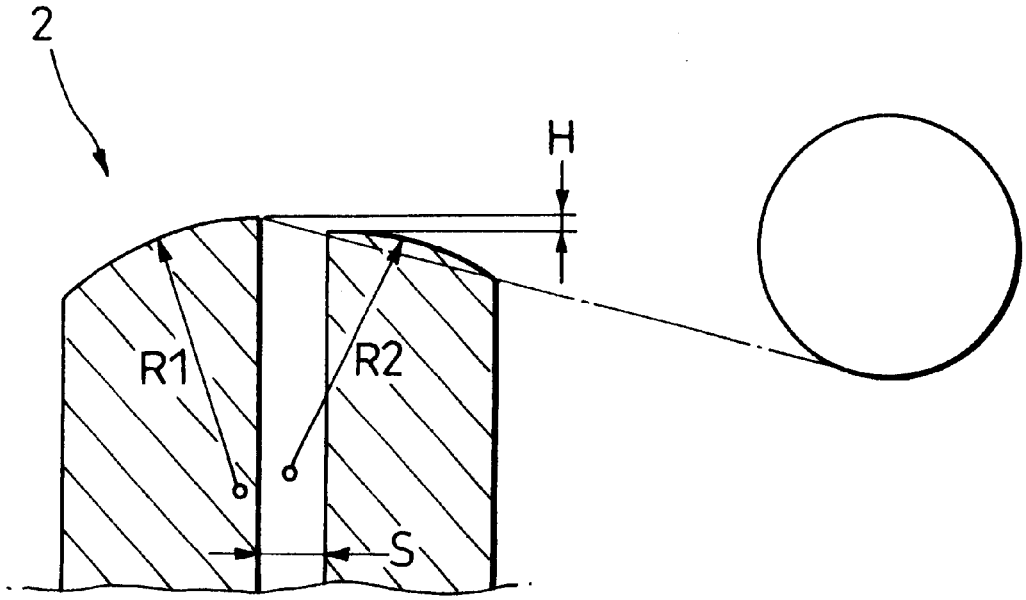
FIG. 5 is a view for explaining examples.

On the other hand, the designed dimensions of the coating head 2 shown in FIG. 5 were as follows. Each of the front edge surface curvature radius R1 and the doctor edge surface curvature radius R2 was 4 mm, the slit width S was 200 μm, and the difference of height between edge surfaces H was 5 μm.

TABLE 3

| | Coating head | Lower-layer composition (wet thickness μm) | Upper-layer composition (wet thicknes μm | Coating surface characteristics | Evaluation |
|---|---|---|---|---|---|
| Example 1 | head 1 | Lower-layer composition 3 (5.0) | Coating composition a (3.0) | good | ○ |
| Example 2 | head 1 | lower-layer composition 4 (5.0) | Coating composition a (3.0) | very good | ◎ |

TABLE 3-continued

| | Coating head | Lower-layer composition (wet thickness μm) | Upper-layer composition (wet thicknes μm | Coating surface characteristics | Evaluation |
|---|---|---|---|---|---|
| Example 3 | head 1 | lower-layer composition 5 (5.0) | Coating composition a (3.0) | good surface characteristic with slight disorder in interface | ○ |
| Example 4 | head 1 | lower-layer composition 5 (2.0) | Coating composition b (3.0) | very good | ◎ |
| Example 5 | head 1 | lower-layer composition 4 (2.0) | Coating composition b (3.0) | good surface characteristic with slight disorder in interface | ○ |
| Example 6 | head 1 | lower-layer composition 5 (2.0) | Coating composition c (3.0) | good surface characteristic with slight disorder in interface | ○ |
| Example 7 | head 2 | lower-layer composition 4 (1.0) | Coating composition a (1.0) | very good | ◎ |
| Example 8 | head 2 | lower-layer composition 4 (1.0) | Coating composition c (1.0) | good | ○ |
| Comparative Example 1 | head 1 | lower-layer composition 1 (5.0) | Coating composition a (3.0) | coating unevenness in the lower layer caused by the air mixed there | X |
| Comparative Example 2 | head 1 | lower-layer composition 2 (5.0) | Coating composition a (3.0) | being coarse in surface | X |
| Comparative Example 3 | head 1 | lower-layer composition 4 (1.0) | Coating composition a (1.0) | streak unevenness in coating | X |

Superior coating could be attained in Examples 1 to 8 in which each of the lower-layer compositions 3 to 5 having a viscosity of 50 cP or less at a shear rate of 10,000 $sec^{-1}$ and a static viscosity of 1 P or more was applied, as shown in Table 3.

Particularly in Examples 1, 2, 4 and 7 in which the difference of viscosity at a shear rate of 10,000 $sec^{-1}$ between the lower-layer composition and the coating composition was set to be 10 cP or less, further superior coating could be attained. Of them, in Examples 2 and 7 in which the lower-layer composition 4 having extremely high static viscosity was applied and in Example 4 in which the lower-layer composition 5 also having extremely high static viscosity was applied, extremely superior coating could be attained.

In Comparative Example 3, the lower-layer composition 4 and the coating composition a were applied to a 1 μm wet thickness respectively by use of the coating head 1. However, a coating failure was produced in the upper layer. On the other hand, when the lower-layer composition 4 and the coating composition a were applied to a 1 μm wet thickness respectively in the same manner as in Comparative Example 3 while using the coating head 2 which was used in Example 7, superior coating could be attained.

Examples 9 to 13 and Comparative Examples 4 and 5

First, any one of 5 kinds of lower-layer compositions shown in Table 1 was applied by an extrusion coater to a wet thickness of 25 μm onto a polyethylene terephthalate support, which was 5 μm thick and which was running at a speed of 400 m/min. Next, a surplus of the lower-layer composition was scraped by use of a coating head 3 shown in FIG. 6 or a coating head 4 shown in FIG. 7, so that a lower layer is formed. Any two of four kinds of coating compositions shown in Table 2 were applied, as an intermediate composition and an upper-layer composition, onto the lower layer.

Table 4 shows the conditions of application and the states of interfaces between respective layers obtained from the observation on the coating film sections.

Figure 6:
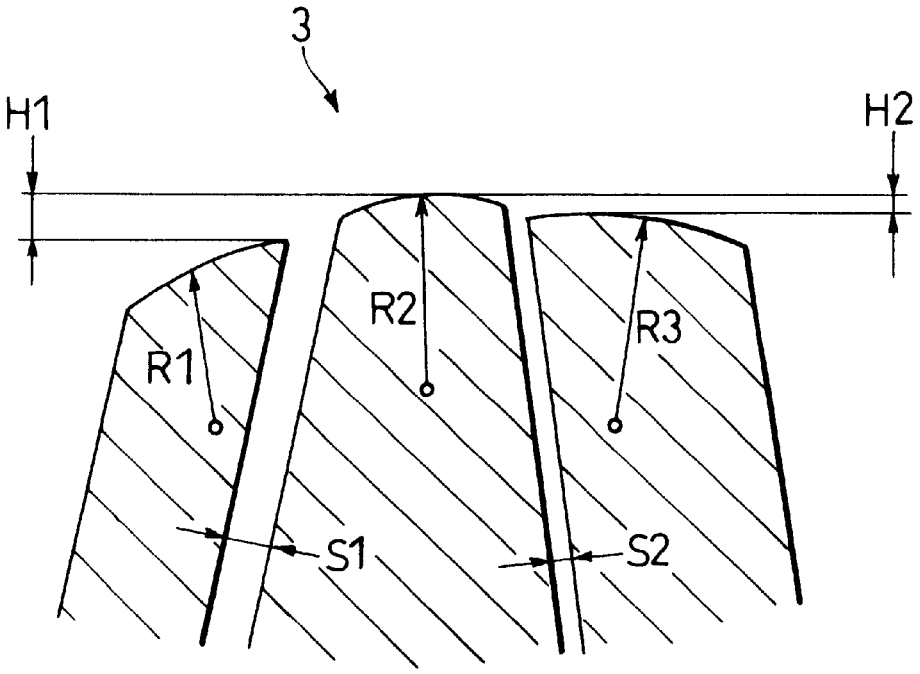
FIG. 6 is a view for explaining examples.

The designed dimensions of the coating head 3 shown in FIG. 6 were as follows. The front edge surface curvature radius R1 was 4 mm, the intermediate doctor edge surface curvature radius R2 was 5 mm, the downstream-side doctor edge surface curvature radius R3 was 6 mm, the slit width S1 was 200 μm, the slit width S2 was 100 μm, the difference of height between edge surfaces H1 was 10 μm, and the difference of height between edge surfaces H2 was 5 μm.

Figure 7:
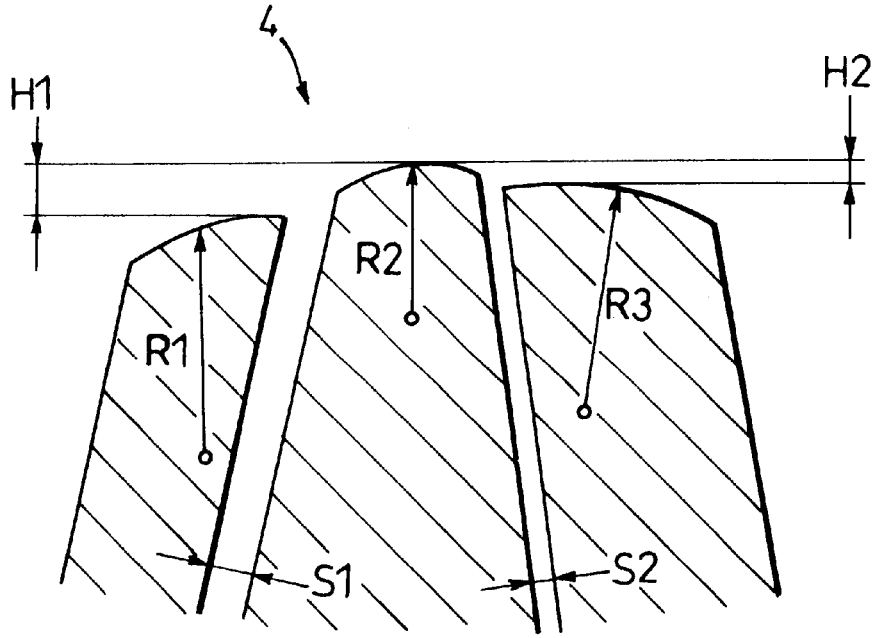
FIG. 7 is a view for explaining examples.

On the other hand, the designed dimensions of the coating head 4 shown in FIG. 7 were as follows. The front edge surface curvature radius R1 was 4 mm, the intermediate doctor edge surface curvature radius R2 was 2 mm, the downstream-side doctor edge surface curvature radius R3 was 4 mm, the slit width S1 was 200 μm, the slit width S2 was 100 μm, the difference of height between edge surfaces H1 was 10 μm, and the difference of height between edge surfaces H2 was 5 μm.

TABLE 4

| | Coating head | Lower-layer composition (wet thickness μm) | Upper-layer composition (wet thicknes μm) | Coating composition (wet thickness μm) | Coating surface characteristic | Evaluation |
|---|---|---|---|---|---|---|
| Example 9 | head 3 | lower-layer composition 3 (2.0) | Coating composition a (0.3) | Coating composition d (0.2) | Good | ○ |
| Example 10 | head 3 | lower-layer composition 4 (2.0) | Coating composition a (0.3) | Coating composition d (0.2) | Very good | ◎ |
| Example 11 | head 3 | lower-layer composition 5 (2.0) | Coating composition a (0.3) | Coating composition d (0.2) | Good surface characteristic with slight disorder in interface | ○ |
| Example 12 | head 3 | lower-layer composition 4 (2.0) | Coating composition b (0.2) | Coating composition a (0.3) | good surface characteristic with slight disorder in interface | ○ |
| Example 13 | head 4 | lower-layer composition 4 (1.0) | Coating composition b (0.2) | Coating composition d 0.3) | good surface characteristic with slight disorder in interface | ○ |
| Compar-tive Examole 4 | head 3 | lower-layer composition 1 (2.0) | Coating composition a (0.3) | Coating composition d (0.2) | coating unevenness in the lower layer caused by the air mixed therein | X |
| Compar-ative Example 5 | head 3 | lower-layer composition 2 (2.0) | Coating composition a (0.3) | Coating composition d (0.2) | being coarse in surface | X |

Superior coating could be attained in Examples 9 to 13 in which each of the lower-layer compositions 3 to 5 having a viscosity of 50 cP or less at a shear rate of 10,000 $sec^{-1}$ and a static viscosity of 1 P or more were applied, as shown in Table 4. Particularly in Examples 9 and 10 in which the differences of viscosity at a shear rate of 10,000 $sec^{-1}$ between the lower-layer composition and the intermediate composition and between the intermediate composition and the upper-layer composition were set to be 10 cP or less, further superior coating could be attained. Of them, in Example 10 in which the lower-layer composition 4 having extremely high static viscosity was applied, extremely superior coating could be attained.

As has been described above in detail, according to the present invention, it is possible to form two or more layers of thin coating films on a flexible support at a high speed without making the surfaces of the coating films rough when the coating films are dried.

While the invention has been described in detail and with reference to specific embodiments thereof, it will be apparent to one skilled in the art that various changes and modifications can be made therein without departing from the spirit and scope thereof.

What is claimed is:

1. A coating method in which an extrusion coating head having a plurality of doctor edge surfaces is pressed onto a flexible support laid and running between pass rollers so as to coat said flexible support with a coating composition ejected from a slit, said method comprising the steps of:

preparing a lower-layer coating composition so as to have a static viscosity of not less than 1P and a viscosity of not more than 50 cP at a shear rate of 10,000 $sec^{-1;}$ excessively applying said lower-layer coating composition directly on an uncoated surface of said support;

scraping a surplus of said lower-layer coating composition by said coating head so that a lower layer is formed;

and applying an upper-layer coating composition, which is ejected from said slit, onto said lower layer, wherein respective coating compositions are prepared so that a difference in viscosity at a shear rate of 10,000 $sec^{-1}$ between coating compositions for layers adjacent to each other does not exceed 10 cP.

2. A coating method according to claim 1, wherein at least a part of a downstream one of said doctor edge surfaces of said coating head projects over a tangent drawn from a downstream end of a most upstream one of said doctor edge surfaces toward a circumferential surface of a first pass roller located downstream from said coating head, said circumferential surface being in contact with said support.

3. A coating method according to claim 1, wherein each of said doctor edge surfaces in said coating head has a curved surface which is convex toward said support, and a minimum value of a curvature radius of said curved surface in any doctor edge surface is smaller than that in any other doctor edge surface located in more downstream side.

4. A coating method according to claim 2, wherein each of said doctor edge surfaces in said coating head has a curved surface which is convex toward said support, and a minimum value of a curvature radius of said curved surface in any doctor edge surface is smaller than that in any other doctor edge surface located in more downstream side.

5. A coating method in which an extrusion coating head having a plurality of doctor edge surfaces is pressed onto a flexible support laid and running between pass rollers so as to coat said flexible support with a coating composition ejected from a slit, said method comprising the steps of:

preparing a lower-layer coating composition so as to have a static viscosity of not less than 1 P and a viscosity of not more than 50 cP at a shear rate of 10,000 $sec^{-1}$;

excessively applying said lower-layer coating composition directly on an uncoated surface of said support;

scraping a surplus of said lower-layer coating composition by said coating head so that a lower layer is formed;

and applying an upper-layer coating composition, which is ejected from said slit, onto said lower layer, wherein respective coating compositions are prepared so that a difference in viscosity at a shear rate of 10,000 $sec^{-1}$ between coating compositions for layers adjacent to each other does not exceed 10 cP, and further wherein a most upstream doctor edge surface has a curved surface which is convex toward said support.

6. A coating method in which an extrusion coating head having a plurality of doctor edge surfaces is pressed onto a flexible support laid and running between pass rollers so as to coat said flexible support with a coating composition ejected from a slit, said method comprising the steps of:

preparing a lower-layer coating composition so as to have a static viscosity of not less than 1 P and a viscosity of not more than 50 cP at a shear rate of 10,000 $sec^{-1}$;

excessively applying said lower-layer coating composition directly on a dried or solidified functional layer formed on a surface of said support in advance of the application of said lower-layer coating composition;

scraping a surplus of said lower-layer coating composition by said coating head so that a lower layer is formed;

and applying an upper-layer coating composition, which is ejected from said slit, onto said lower layer, wherein respective coating compositions are prepared so that a difference in viscosity at a shear rate of 10,000 $sec^{-1}$ between coating compositions for layers adjacent to each other does not exceed 10 cP.

7. A coating method according to claim 6, wherein said functional layer is an adhesive layer.

8. A coating method in which an extrusion coating head having a plurality of doctor edge surfaces is pressed onto a flexible support laid and running between pass rollers so as to coat said flexible support with a coating composition ejected from a slit, said method comprising the steps of:

preparing a lower-layer coating composition so as to have a static viscosity of not less than 1 P and a viscosity of not more than 50 cP at a shear rate of 10,000 $sec^{-1}$;

excessively applying said lower-layer coating composition directly on a dried or solidified functional layer formed on a surface of said support in advance of the application of said lower-layer coating composition;

scraping a surplus of said lower-layer coating composition by said coating head so that a lower layer is formed;

and applying an upper-layer coating composition, which is ejected from said slit, onto said lower layer, wherein respective coating compositions are prepared so that a difference in viscosity at a shear rate of 10,000 $sec^{-1}$ between coating compositions for layers adjacent to each other does not exceed 10 cP, and further wherein a most upstream doctor edge surface has a curved surface which is convex toward said support.

9. A coating method according to claim 8, wherein said functional layer is an adhesive layer.

* * * * *